US005632358A

United States Patent [19]

Maeda et al.

[11] Patent Number: 5,632,358

[45] Date of Patent: May 27, 1997

[54] ELEVATOR ROLLER GUIDE

[75] Inventors: Koichi Maeda, Yokohama; Yoshito Aoishi, Tama, both of Japan

[73] Assignee: Otis Elevator Company, Farmington, Conn.

[21] Appl. No.: 430,917

[22] Filed: Apr. 28, 1995

[30] Foreign Application Priority Data

Aug. 3, 1994 [JP] Japan ..... 6-182023

[51] Int. Cl.[6] ..... B66B 7/04

[52] U.S. Cl. ..... 187/410

[58] Field of Search ..... 187/345, 409, 187/410, 414; 105/153; 104/245

[56] References Cited

U.S. PATENT DOCUMENTS

| | | | |
|---|---|---|---|
| 2,498,299 | 2/1950 | Rissler | 187/410 X |
| 3,087,583 | 4/1963 | Bruns | 187/410 X |
| 3,099,334 | 7/1963 | Tucker, Jr. | 187/410 X |
| 3,669,222 | 6/1972 | Takamura et al. | 187/410 |
| 5,086,882 | 2/1992 | Sugahara et al. | 187/410 |
| 5,107,963 | 4/1992 | Rocca et al. | 187/410 |
| 5,117,946 | 6/1992 | Traktovenko et al. | 187/410 |
| 5,289,902 | 3/1994 | Fujita | 187/95 |

FOREIGN PATENT DOCUMENTS

| | | | |
|---|---|---|---|
| 1215321 | 4/1966 | Germany . | |
| 2009246 | 1/1977 | Japan | 187/410 |
| 3131641 | 11/1978 | Japan | 187/410 |
| 4197978 | 7/1992 | Japan | 187/410 |
| 4313584 | 11/1992 | Japan . | |
| 5124783 | 5/1993 | Japan | 187/410 |
| 5116869 | 5/1993 | Japan | 187/410 |
| 5186163 | 7/1993 | Japan | 187/410 |
| 1030728 | 5/1966 | United Kingdom . | |

OTHER PUBLICATIONS

JPO and JAPIO English Abstract for JP 4313584A, Mar. 19, 1993.

*Primary Examiner*—James W. Keenan
*Attorney, Agent, or Firm*—Joseph P. Abate

[57] ABSTRACT

An elevator roller guide includes a platform 12 having a supporting arm portion 12*a* and being arranged on a cage, a roller 3 in contact with a guide rail erected in a channel, an arm 6 which supports the roller 3 in a freely rotatable manner and which is arranged on the platform 12 in a freely rockable manner, and a spring 16 arranged between the arm 6 and the supporting arm portion 12*a* of the platform 12. The guide further includes a stopper rod 13 arranged on the supporting arm portion 12*a* at a position separated by a certain distance in the horizontal direction from the arm 6 on the side of the rocking direction and separated by a certain distance from the spring 16; and a viscoelastic part 63 arranged between the stopper rod 13 and said arm 6. The viscoelastic part 63 is deformed in the shear direction alone, and its damping effect can be efficiently realized. Also, when the hardness of the viscoelastic part 63 is adjusted, the strength of the spring 16, which has already been adjusted, is not inaccurate; thus, there is no need to make readjustment of the spring 16.

7 Claims, 3 Drawing Sheets

ELEVATOR ROLLER GUIDE

TECHNICAL FIELD

This invention relates to roller guides and, particularly, to roller guides for guiding an elevator car along guide rails installed in a shaft or hoistway.

BACKGROUND OF THE INVENTION

A conventional elevator roller guide is shown in FIG. 8. Also, see, for example, Japanese Kokai Patent No. Hei 4[1992]-313584 which is hereby incorporated by reference in its entirety. In FIG. 8, a guide rail 101 is installed vertically in an elevator shaft. A roller guide 103, which guides a car 102, is engaged with the guide rail 101.

The roller guide 103 has rollers 104, 105, 106 that contact the guide rail 101 from three directions, as shown in FIG. 9. The roller 104 is held on an arm 107 so as to turn freely. The arm 107 is attached to a base (or platform) 108 so as to rock freely. A support rod 110, which is embedded in a support arm section 109 of the base 108, is inserted through the arm 107. A spring 112 is mounted between a nut 111, which is threaded on the support rod 110, and the arm 107. A viscoelastic member 113 is mounted between the arm 107 and the nut 111. The viscoelastic member 113 includes an outer tube 114 attached to the arm 107, an inner tube 115 attached to the support rod 110, and a viscoelastic material 116 that is adhered to the inner and outer tubes 114, 115. The other rollers 105, 106 have the same construction as the roller 104.

As the car 102 moves vertically, guided by the guide rail 101, the roller 104 vibrates, and this vibration is reduced by the spring 112. Even with this spring 112, however, the roller 104 continues to vibrate, so that this continued vibration will be damped by a deformation of the viscoelastic material 116 in the direction of shear.

The spring 112 is adjusted to the appropriate tension by the nut 111. Then, the car 102 is operated and tested and, if required, the rigidity of viscoelastic member 113 is adjusted.

With this type of conventional elevator roller guide, however, when the roller 104 vibrates, the arm 107 rocks. Because the viscoelastic member 113 is placed or located in the direction in which the arm 107 rocks, the viscoelastic member 113 is greatly deformed not only in the direction of shear, but also in the directions of compression and tension. The present inventors believe that a problem has been that the member 113 cannot exhibit or produce sufficient damping effects when located as in the conventional guide.

To replace the viscoelastic member 113 with another viscoelastic member of an appropriate rigidity so that its rigidity can be adjusted, the spring 112 and the adjustment means 111 must first be removed because the spring 112 is adjacent to the viscoelastic member 113. The member 113 can then be replaced, but the tension of the spring 112 must again be adjusted; this is a complicated practice.

DISCLOSURE OF THE INVENTION

A principal object of the present invention is to provide an elevator guide roller in which the viscoelastic member that dampens vibration will be deformed only in the direction of shear, and in which the spring will not be affected when the viscoelastic member is replaced.

To achieve this and other objects, an elevator roller guide according to the present invention includes a base or platform that has a support arm section, a roller for contact with a guide rail, an arm on which the roller is mounted to turn or rotate freely, the arm being installed to rock freely on the base, a spring mounted between the arm and the support arm section of the base, an auxiliary arm section installed in the support arm section so that the auxiliary arm section is oriented horizontally at a distance to a side of the direction in which the arm rocks, the auxiliary arm section being separated from the spring, and a viscoelastic member mounted between the auxiliary arm section and the arm.

When the elevator car moves vertically, drawn by a hoist, etc., the roller guide roller moves along the top of the guide rail. The roller vibrates when there is a level difference in the guide rail. This vibration is reduced by the spring. Also, even with the spring, the roller vibrates, and this vibration will be damped by the viscoelastic member. Because the viscoelastic member is placed horizontally at a distance to a side of the direction in which the arm rocks, the member will be deformed only in the direction of shear and its damping effects can be more efficiently realized.

After the spring is adjusted to an appropriate tension, the car is run and tested and, if required, the rigidity of the viscoelastic member adjusted. Because the viscoelastic member is separated from the spring, the viscoelastic member will not disrupt the already-adjusted spring tension during an adjustment of the viscoelastic member.

Further and still other objects of the present invention will become more readily apparent when the following detailed description is taken in conjunction with the accompanying drawing, in which:

BEST MODE FOR CARRYING OUT THE INVENTION

FIGS. 1 through 6 show a first preferred embodiment of an elevator roller guide according to the present invention.

Figure 1:
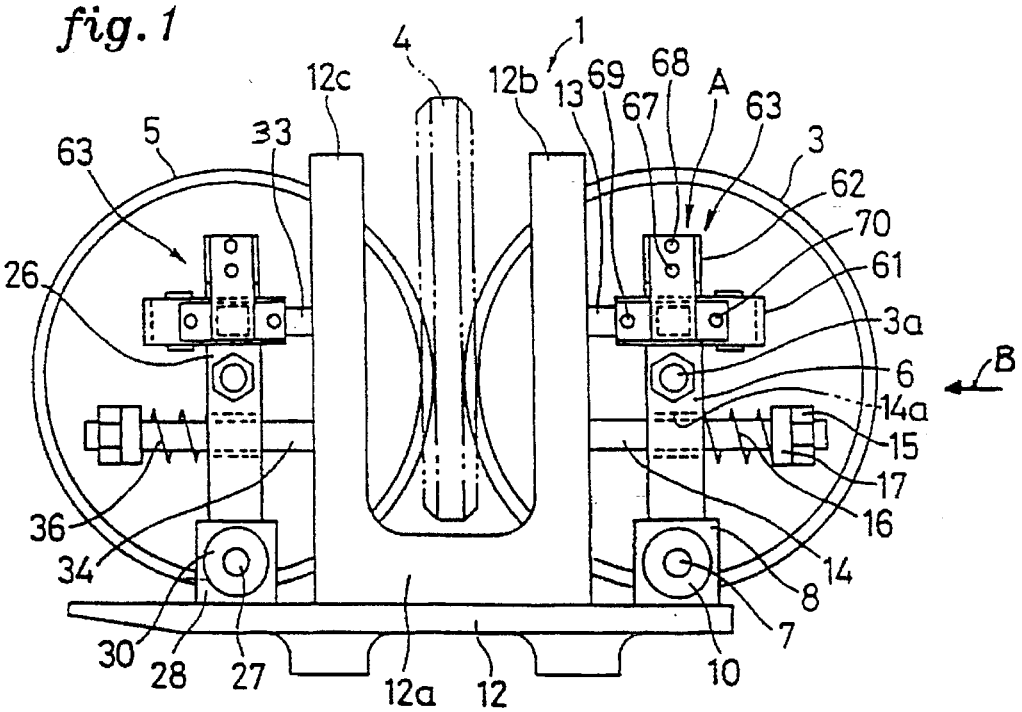
FIG. 1 is a front view of a first preferred embodiment of an elevator roller guide according to the present invention.

In FIG. 1, a roller guide 1 engages with a guide rail (not shown) to slide freely in an elevator shaft (not shown), and has a plurality (e.g., three) of rollers 3, 4, 5 that make contact with the guide 1 rail from three directions.

Figure 2:
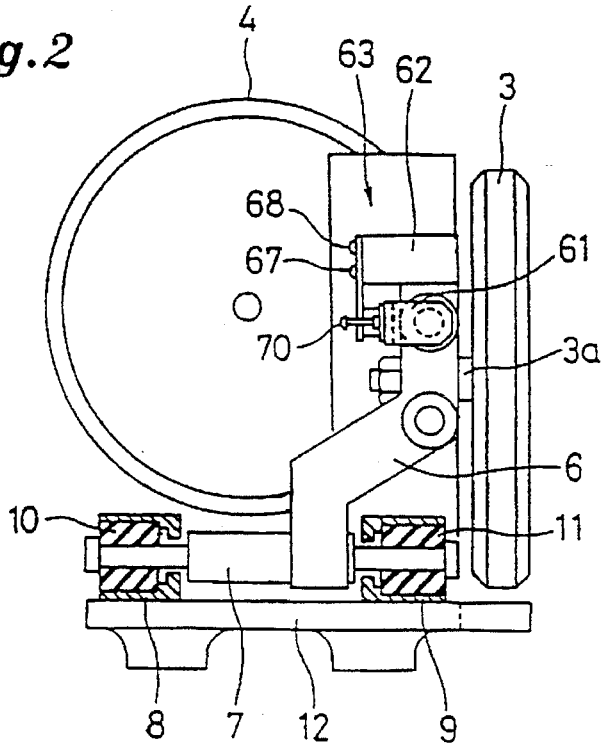
FIG. 2 is a side view, partly in section, of the guide as shown in the direction of arrow B in FIG. 1.

As shown in FIG. 2, the roller 3 is held or mounted by the arm 6 so as to turn or rotate freely. A support shaft 7 is affixed to the base end of the arm 6. Both ends of the support shaft 7 are held by a pair of bearing members 8, 9, formed as tubes. First buffer members 10, 11, made, e.g., of synthetic rubber are mounted between the pair of bearing members 8, 9 and the support shaft 7.

Figure 3:
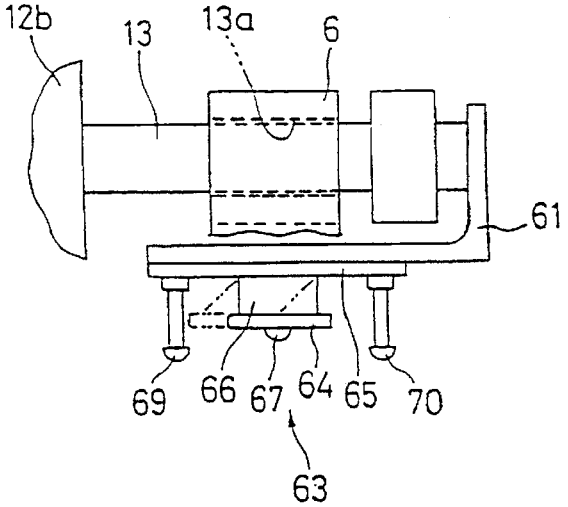
FIG. 3 is an enlarged plan view of part A in the direction of the arrow A in FIG. 1.

The bearing members 8, 9 are secured to a base 12. The base 12 is installed on a car (not shown). The arm 6 is mounted so as to rock freely by means of the base 12 via the support shaft 7 and the bearing members 8, 9. Also, a support arm section 12*a*, which overall has the shape of a U, is affixed onto the base 12. As shown in FIG. 3 and FIG. 1, a stopper rod 13 and a support rod 14 are embedded in one side 12*b* of the support arm section 12*a* of the base 12. The stopper rod 13 and the support rod 14 are inserted through insertion holes 13*a*, 14*a* formed in the arm 6. A nut 15 is attached to the forward end of the support rod 14, and a spring 16 is compressed between the nut 15 and the arm 6. The stopper rod 13 suppresses significant rocking by the roller 3. In addition, a second buffer member 17 made of, e.g., synthetic rubber is mounted between the spring 16 and the nut 15.

The roller 5 is positioned to be symmetrical with respect to the roller 3, as shown in FIG. 1. In the same way as the roller 3, the roller 5 is held to turn freely by the arm 26, and the arm 26 is held to rock freely by the base 12 via a support shaft 27 and a pair of bearing members 28 (only one is shown). A pair of first buffer members 30 (only one is shown) is mounted between the bearing member 28 and the support shaft 27. In addition, a stopper rod 33 and a support rod 34 are embedded in the other side 12*c* of the support arm section 12*a*, and a spring 36 is compressed between the support rod 34 and the arm 26.

Figure 4:
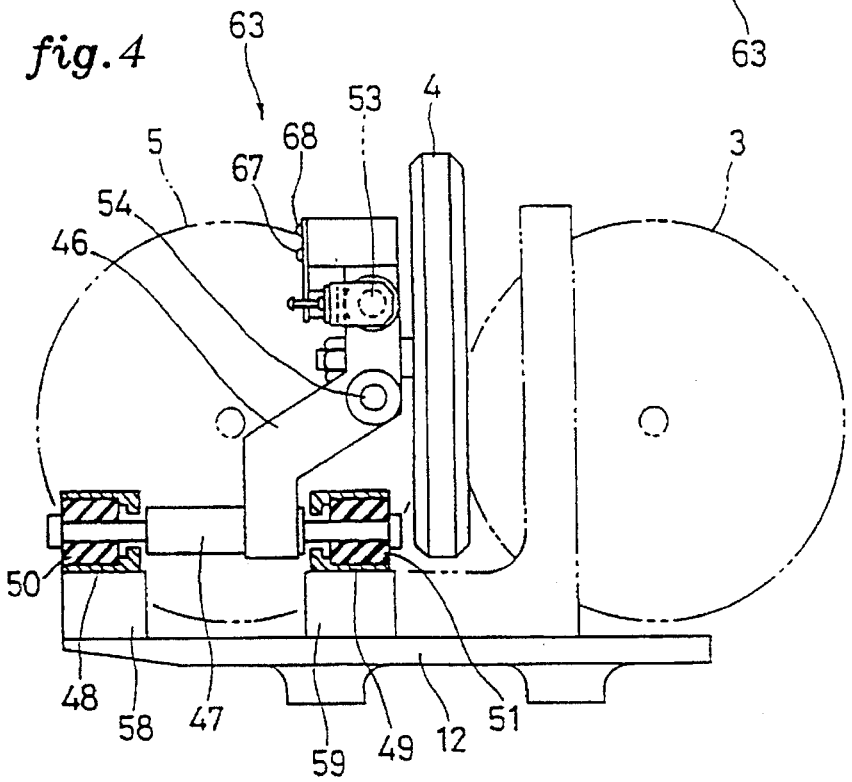
FIG. 4 is another front view of the roller guide of FIG. 1, for explaining the invention as applied to the roller 4.

The roller 4, which touches or otherwise contacts an edge portion of the guide rail, is also held in the same way as the rollers 3, 5 to turn freely by an arm 46, as shown in FIG. 4. The arm 46 is held by bearing members 48, 49 via a support shaft 47. The support shaft 47 lies over the support shaft 7 of the roller 3, so that the bearing members 48, 49 are installed on the base 12 via auxiliary members 58, 59, respectively. In addition, first buffer members 50, 51 are mounted between the bearing members 48, 49 and the support shaft 47. A stopper rod 53 and a support rod 54 are embedded in one side 12*b* of the support arm section 12*a*.

Returning to FIG. 3, a bracket 61, with an L-shaped cross section, is affixed to the forward end of the stopper rod 13. The bracket 61 extends as far as the position of the arm 6. In addition, as shown in FIG. 2, an auxiliary arm 62 is affixed to the top end of the arm 6 and is oriented in the direction of the axis of a rotation shaft 3*a* of the roller 3. A viscoelastic member 63 is mounted between the auxiliary arm 62 and the bracket 61 to be positioned at a distance horizontally to a side of the direction in which the arm 6 rocks. See FIGS. 2, 3.

Figure 5:
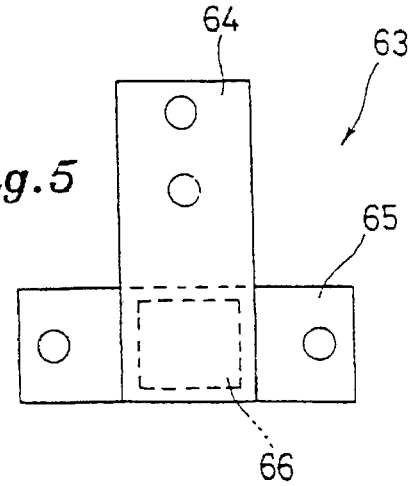
FIG. 5 is a front view of a viscoelastic member.
Figure 6:
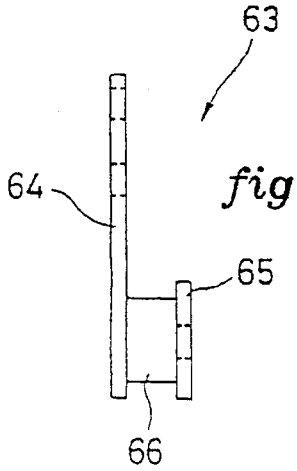
FIG. 6 is a side view of the viscoelastic member.

As shown in FIGS. 5 and 6, the viscoelastic member 63 comprises a first fastening plate 64 which is placed vertically, a second fastening plate 65 which is placed horizontally, and a viscoelastic material 66 which is positioned between the first and second fastening plates 64, 65 and which is adhered to the plates 64, 65.

The first fastening plate 64 is affixed to the auxiliary arm 62 by bolts 67, 68, and the second fastening plate 65 is affixed to the bracket 61 by bolts 69, 70. The bolts 69, 70 also serve the role of suppressing significant movement of the first fastening plate 64. The stopper rod 13 and the bracket 61, together, constitute an auxiliary arm member.

The viscoelastic material 66 is positioned to a side of the direction in which the arm 6 rocks and will be deformed only in the direction of shear by the arm 6 and the stopper rod 13.

For the rollers 4, 5, the respective viscoelastic members 63 are also mounted between the arms 26, 46 and the stopper rods 33, 53.

When the car, drawn by a hoist, etc., moves vertically, the roller guide roller 3 will turn (or rotate) along the top of the guide rail (as do the other rollers 4, 5). The roller 3 vibrates when there is a level difference in the guide rail, and this vibration is reduced by the spring 16. In addition, the roller 3 vibrates even with the spring 16 in this case, and this vibration will be damped by the viscoelastic member 63. Because the viscoelastic member 63 is placed at a distance horizontally to a side of the direction in which the arm 6 rocks, the member 63 will be deformed only in the direction of shear and its damping effects will be more efficiently realized.

At the same time, after the spring 16 is adjusted to an appropriate tension by the nut 15, the car is run and tested and the rigidity of viscoelastic member 63 is adjusted, if required.

The bolts 67–70, which affix the first and second fastening plates 64, 65, are loosened from the auxiliary arm 62 and the bracket 61, and the previously installed viscoelastic member 63 (i.e., elements 64, 65, 66) is removed. Next, the first and second fastening plates of another, new viscoelastic member (that is a viscoelastic member of a different size or composition) are affixed to the auxiliary arm 62 and the bracket 61 by the bolts. In this case, because the viscoelastic member 63 is separated from the spring 16, the already-adjusted tension of the spring 16 will not be disrupted by this replacement.

When the car, drawn by a hoist, etc., moves vertically, the roller 3 of the roller guide 1 will turn along the top of guide rail 2. The surfaces of the guide rail 2 and the roller 3 that make contact with each other are not necessarily smooth; therefore, some vibration will occur in the turning roller 3. In addition, vibration will be produced by the turning of the roller's rotation shaft itself. This vibration will be reduced by the spring 16, which presses the roller 3, but a high frequency vibration of 100 Hz or more will be transmitted to the support rod 14 and to the base 12 from the arm 6, and to the spring 16, support shaft 7, and the support arm section 12*a* of the base 12 from the arm 6. First buffer members 10, 11 are mounted between the support shaft 7 and the base 12, however, and the second buffer member 17 is mounted between the spring 16 and the support rod 14, so that the aforementioned high frequency vibration will be reduced by these first and second buffer members 10, 11 and 17. Note that the same occurs for the other rollers 4, 5.

Figure 7:
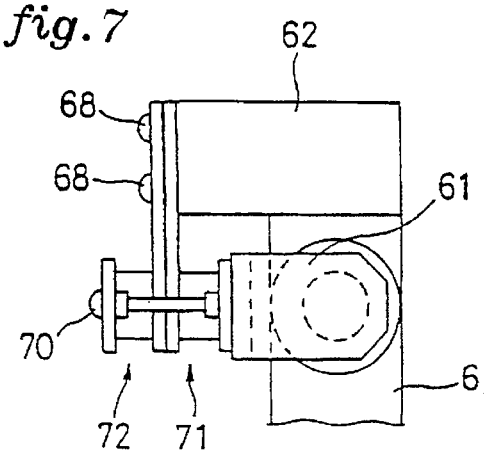
FIG. 7 is an enlarged side view of a second preferred embodiment of the roller guide according to the invention.
Figure 8:
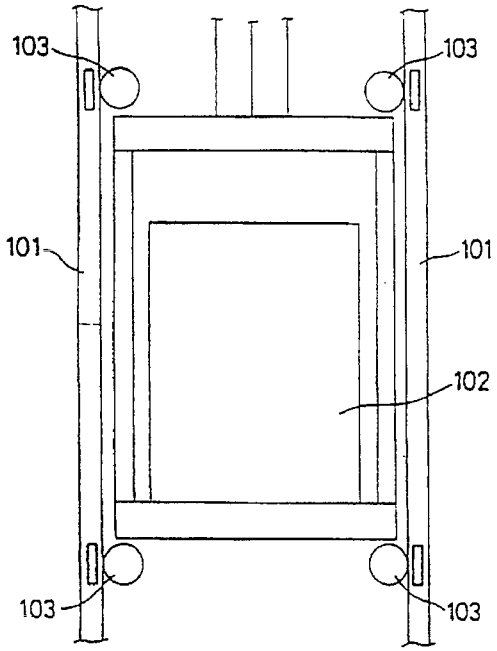
fig. 8 prior art
FIG. 8 is a front view of a conventional elevator car in a hoistway.
Figure 9:
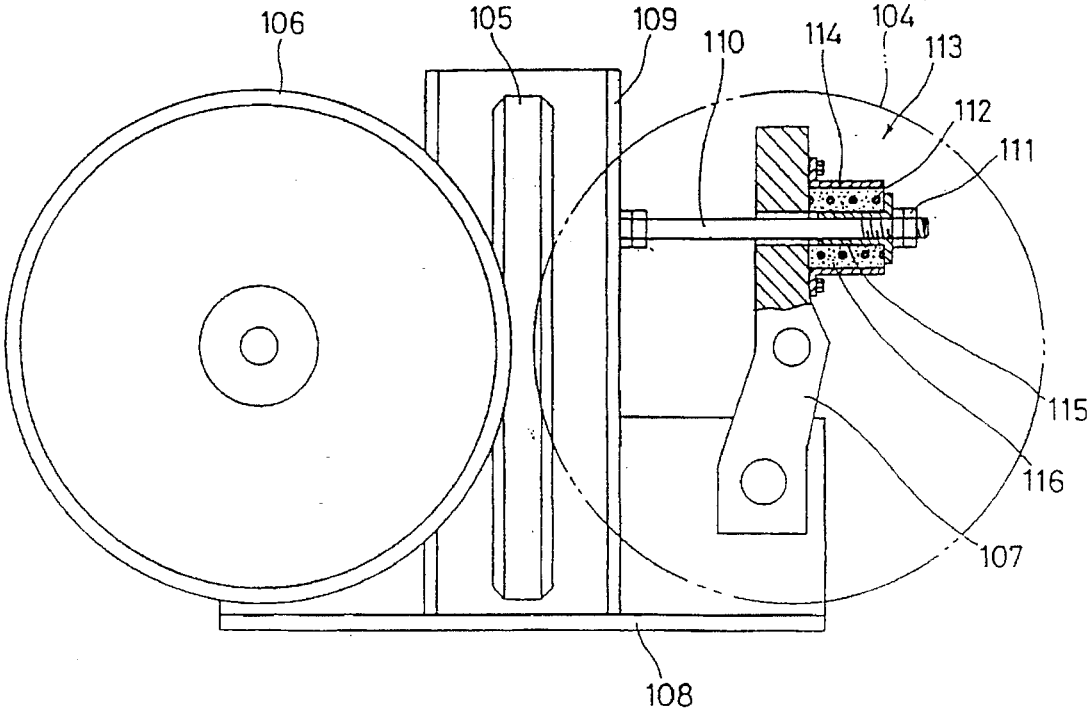
fig. 9 prior art
FIG. 9 is a front view of a conventional elevator roller guide.

Next, a second preferred embodiment of an elevator roller guide according to this invention is shown in FIG. 7. In this second embodiment, several (e.g., two) viscoelastic members 71, 72 are stacked between the bracket 61 and the auxiliary arm 62, and their rigidity is, thus, increased.

As explained above, with this invention, an auxiliary arm member is installed on the aforementioned support arm section to be positioned at a distance horizontally to the side of the direction in which the arm rocks, and to be separated from the aforementioned spring. A viscoelastic member is mounted between this auxiliary arm member and the aforementioned arm, so that the viscoelastic member will be deformed only in the direction of shear so that its damping effects will be more efficiently realized. In addition, when the rigidity of the viscoelastic member is adjusted, the already-adjusted spring tension will not be affected and the labor to readjust it will be eliminated.

Various changes to the above description may be made without departing from the spirit and scope of the present invention.

What is claimed is:

1. An elevator roller guide, comprising:

a platform having a supporting arm portion; a roller; an arm supporting said roller in a freely rotatable manner, said arm being fixed to a support shaft arranged on said platform in a freely rockable manner so that said arm is roackable with said support shaft in rocking directions away from and towards said supporting arm portion; a spring arranged at a side of said arm facing away from said supporting arm portion; an auxiliary arm part arranged on said supporting arm portion at a position separated by certain distance in a horizontal direction from a side of said arm facing toward said supporting arm portion by a certain distance from said spring, and a viscoelastic part arranged between said auxiliary arm part and said arm, wherein said viscoelastic part includes a viscoelastic material, said viscoelastic material being a unitary part having an axis of compression oriented in a direction transversely of a direction in which an axis of compression for said spring is oriented, said axis of compression of said viscoelastic material being oriented also in a direction transversely of said rocking directions and also parallel to said support shaft, so that a movement of said arm in one of said rocking directions deforms said viscoelastic material in only a shear direction which is transversely of said axis of compression of said viscoelastic material.

2. An elevator roller guide as claimed in claim 1, wherein said auxiliary arm part comprises a rod having one end fixed to said supporting arm portion and having another end fixed to a bracket.

3. An elevator roller guide as claimed in claim 2, wherein said bracket is L-shaped.

4. An elevator roller guide as claimed in claim 1, wherein said supporting arm portion includes a generally U-shaped section and a support rod, said support rod extending from said U-shaped section, said spring being arranged around said support rod.

5. A guide as claimed in claim 4, further including a buffer member arranged on said support rod and engaged with said spring.

6. A guide as claimed in claim 5, wherein said buffer member is formed of a synthetic rubber.

7. A guide as claimed in claim 1, wherein said viscoelastic part comprises a first plate fixed to said auxiliary arm part, a second plate fixed to said auxiliary arm part, and said viscoelastic material is disposed between said plates.

* * * * *